US010725425B2

(12) United States Patent
Fujinaka et al.

(10) Patent No.: US 10,725,425 B2
(45) Date of Patent: Jul. 28, 2020

(54) IMAGE FORMING APPARATUS

(71) Applicant: CANON KABUSHIKI KAISHA, Tokyo (JP)

(72) Inventors: Hiromi Fujinaka, Chofu (JP); Shinji Kubo, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/360,617

(22) Filed: Mar. 21, 2019

(65) Prior Publication Data

US 2019/0310583 A1 Oct. 10, 2019

(30) Foreign Application Priority Data

Apr. 10, 2018 (JP) ..... 2018-075511

(51) Int. Cl.
*G03G 21/16* (2006.01)
*G03G 21/18* (2006.01)

(52) U.S. Cl.
CPC ..... *G03G 21/1633* (2013.01); *G03G 21/1814* (2013.01)

(58) Field of Classification Search
CPC ..... G03G 21/1633; G03G 21/1839; G03G 21/1842; G03G 21/1853; G03G 2221/169
See application file for complete search history.

(56) References Cited

U.S. PATENT DOCUMENTS 5,406,355 A * 4/1995 Komuro ..... G03G 21/1821 399/111
7,298,989 B2 11/2007 Nishimura
7,496,317 B2 2/2009 Igarashi et al.

FOREIGN PATENT DOCUMENTS

JP 62258477 A * 11/1987
JP 2005-352058 A 12/2005
JP 2007-086628 A 4/2007
JP 2013-155012 A 8/2013
JP 2013-184754 A 9/2013

* cited by examiner

*Primary Examiner* — Erika J Villaluna
(74) *Attorney, Agent, or Firm* — Venable LLP

(57) ABSTRACT

An image forming apparatus includes an apparatus body including an opening portion, a cover configured to cover the opening portion in a state being closed, a cartridge configured to be attached to and detached from the apparatus body through the opening portion, a sheet discharge portion including a first rotary member and a second rotary member configured to nip and discharge the sheet, and a supporting portion configured to rotatably support the first rotary member and move to a first position where the first rotary member overlaps with a movement locus of the cartridge and to a second position where the first rotary member does not overlap with the movement locus, the movement locus being a passage area through which the cartridge passes while being attached to and detached from the apparatus body.

19 Claims, 10 Drawing Sheets

IMAGE FORMING APPARATUS

BACKGROUND OF THE INVENTION

Field of the Invention

The present invention relates to an image forming apparatus for forming an image on a sheet.

Description of the Related Art

An image forming apparatus such as a printer having a top cover provided on an upper portion of a main body that can be opened to enable a process cartridge to be replaced from an upper side of the body is proposed (refer to Japanese Patent Application Laid-Open Publication No. 2013-155012). In the image forming apparatus disclosed in Japanese Patent Application Laid-Open Publication No. 2013-155012, an opening appears when the top cover is opened, and the process cartridge can be taken out through the opening.

However, according to the image forming apparatus disclosed in Japanese Patent Application Laid-Open Publication No. 2013-155012, while taking out the process cartridge, the process cartridge passes through a space formed between a sheet discharge roller and a scanner unit. Since space must be ensured through which the process cartridge can pass, the sheet discharge roller and the scanner unit cannot be arranged close to one another, and downsizing of the apparatus was difficult.

SUMMARY OF THE INVENTION

According to a first aspect of the present invention, an image forming apparatus includes an apparatus body including an opening portion, a cover supported in an openable and closable manner on the apparatus body and configured to cover the opening portion of the apparatus body in a state being closed, a cartridge configured to be attached to and detached from the apparatus body through the opening portion, the cartridge comprising a photoreceptor configured to bear a toner image, a sheet discharge portion including a first rotary member and a second rotary member configured to nip and discharge the sheet on which the toner image has been transferred, and a supporting portion configured to rotatably support the first rotary member and move, when viewed in an axial direction of the first rotary member, to a first position where the first rotary member overlaps with a movement locus of the cartridge and to a second position where the first rotary member does not overlap with the movement locus, the movement locus being a passage area through which the cartridge passes while being attached to and detached from the apparatus body.

According to a second aspect of the present invention, an image forming apparatus includes an apparatus body including an opening portion, a cover supported in an openable and closable manner on the apparatus body and configured to cover the opening portion of the apparatus body in a state being closed, a cartridge configured to be attached to and detached from the apparatus body through the opening portion, the cartridge comprising a developing member configured to develop a toner image on a photoreceptor, a sheet discharge portion including a first rotary member and a second rotary member configured to nip and discharge the sheet on which the toner image has been transferred, and a supporting portion configured to rotatably support the first rotary member and move, when viewed in an axial direction of the first rotary member, to a first position where the first rotary member overlaps with a movement locus of the cartridge and to a second position where the first rotary member does not overlap with the movement locus, the movement locus being a passage area through which the cartridge passes while being attached to and detached from the apparatus body.

Further features of the present invention will become apparent from the following description of exemplary embodiments with reference to the attached drawings.

DESCRIPTION OF THE EMBODIMENTS

First Embodiment

Figure 1:
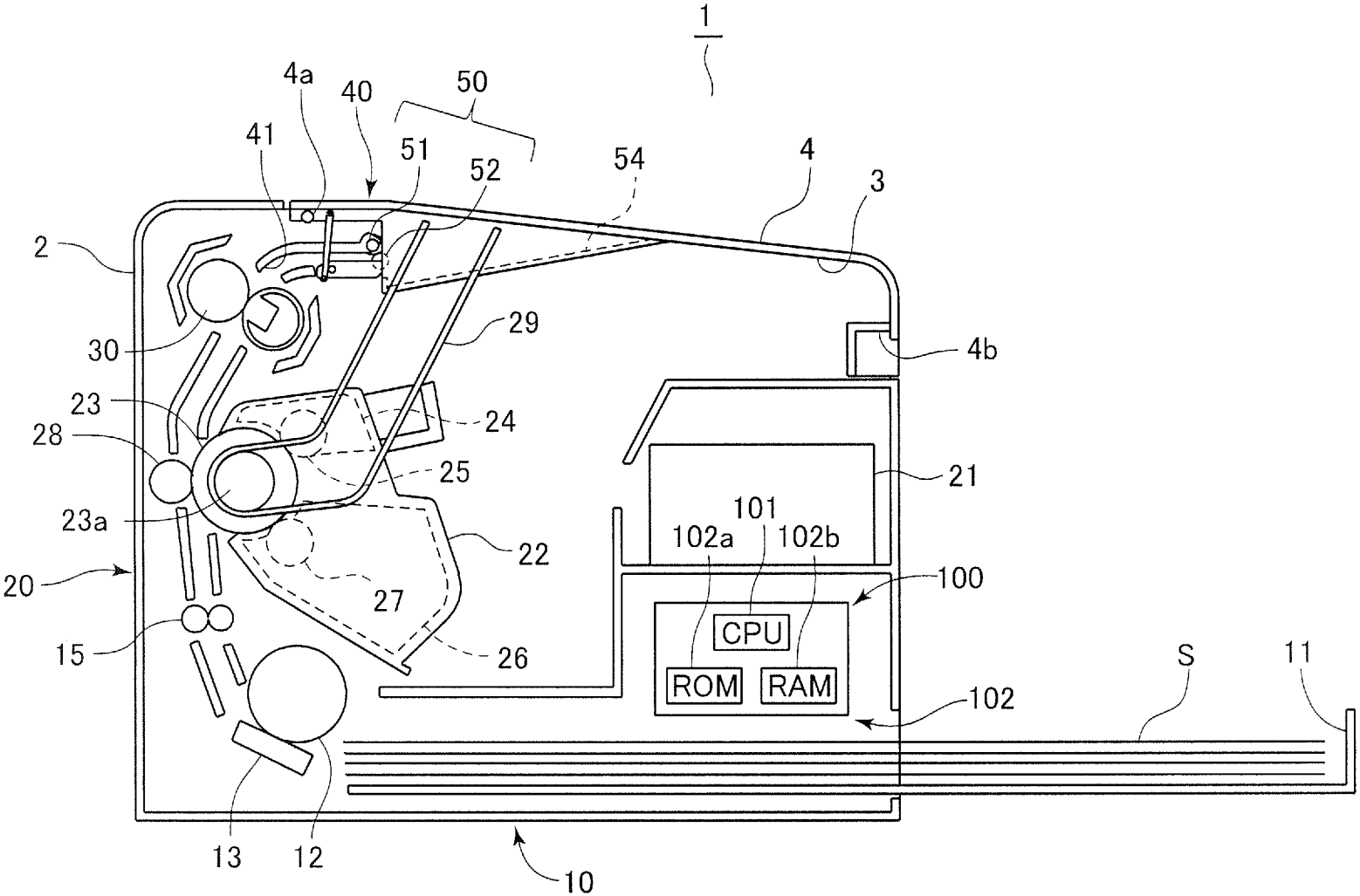
FIG. 1 is a schematic view illustrating a configuration of a printer according to a first embodiment.
Figure 2:
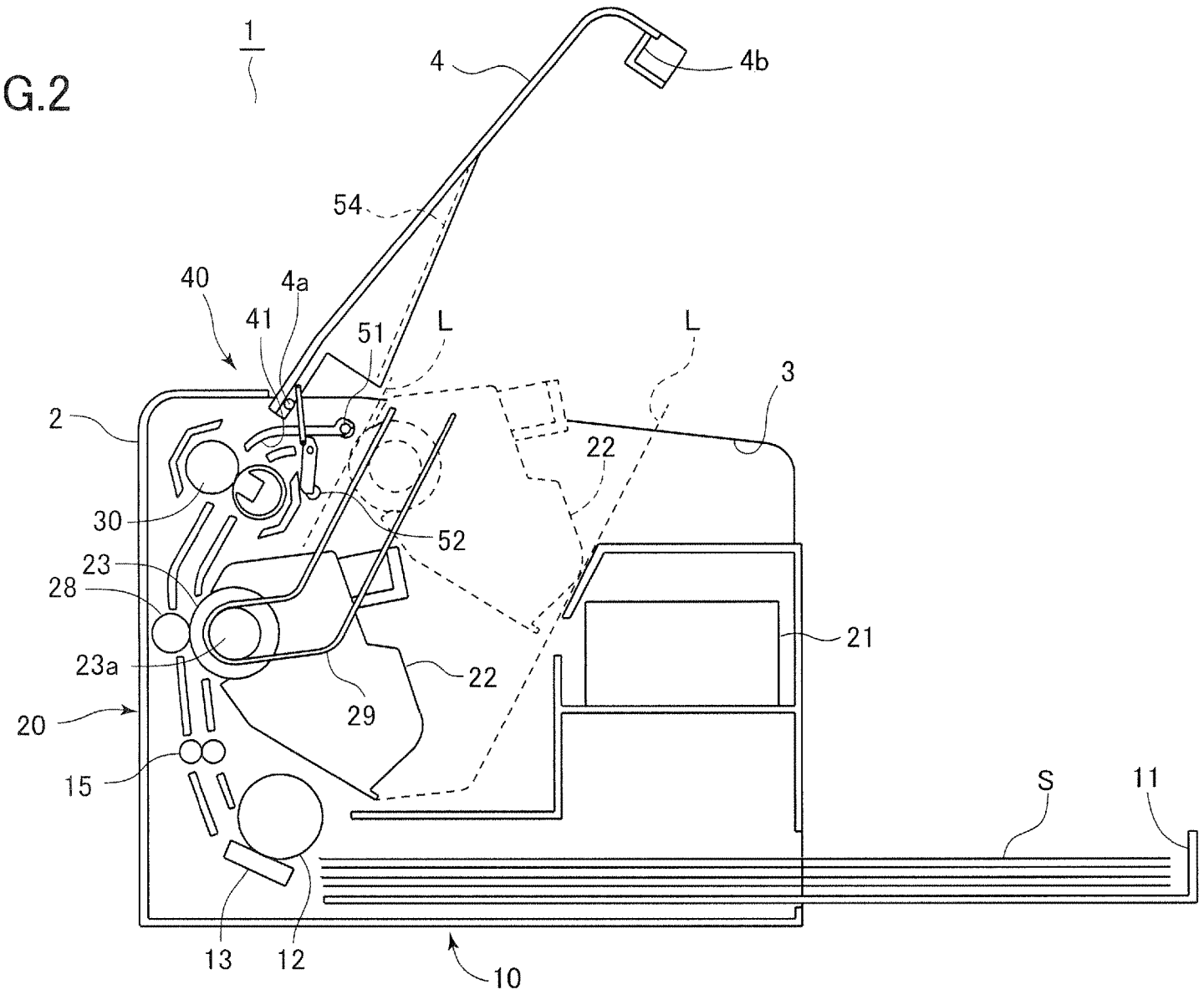
FIG. 2 is a schematic view illustrating a printer with an opening/closing cover in an opened state.

Now, an image forming apparatus according to a first embodiment of the present disclosure will be described with reference to the drawings. An image forming apparatus according to the first embodiment is an image forming apparatus that includes a fixing unit capable of fixing a toner image formed on a sheet to the sheet by applying heat and pressure, such as a copying machine, a printer, a facsimile machine or a multifunction device having these functions. In the following description of embodiments, a printer 1, which is a monochrome laser beam printer adopting an electrophotographic system, is taken as an example for illustrating the image forming apparatus. As illustrated in FIGS. 1 and 2, the printer 1 includes a sheet feeding apparatus 10 having a sheet feed tray 11 that can be inserted into and drawn out of a printer body 2 serving as an apparatus body, an image forming unit 20 for forming an image on a sheet, and a fixing roller pair 30 serving as a fixing unit.

FIG. 1 is a view illustrating the printer 1 having an opening portion 3 formed on an upper portion of the printer body 2 covered by closing an opening/closing cover 4 serving as a cover supported in an openable and closable manner with respect to the printer body 2. FIG. 2 is a view illustrating the printer 1 with the opening/closing cover 4 opened and the opening portion 3 made visible. A sheet S refers to a thin sheet-shaped recording medium such as paper in the shape of a sheet, an envelope or the like, a plastic film (OHT) for overhead projectors, cloth and so on. In the following description, terms indicating positional relationships of up, down, right, left, front and rear are described based on a state where the printer 1 with the opening/closing cover 4 closed is viewed from a side, that is, the viewpoint of FIG. 1.

General Configuration of Printer

If an image forming command is output to the printer 1, an image forming process by the image forming unit 20 is started based on image information entered from an external computer and the like connected to the printer 1, and an image signal is created by a control unit 100 based on image information. The control unit 100 includes a CPU 101 and a memory 102 including a ROM 102*a* that stores programs for controlling respective units and a RAM 102*b* that temporarily stores data. The CPU 101 is connected via an input/output circuit to various driving sources, sensors and so on, and communicates signals with respective units and also controls operations thereof.

The image forming unit 20 comprises a process cartridge 22 serving as a cartridge attached removably inside the printer body 2, a laser scanner 21 and a transfer roller 28. The process cartridge 22 includes a drum cartridge 24 including a photosensitive drum 23 and a charge roller 25 that charges the photosensitive drum 23, and a developer cartridge 26 including a developing roller 27 for forming a toner image on the photosensitive drum 23. Based on the image signal being created, the laser scanner 21 irradiates a laser beam to the photosensitive drum 23 that has been charged uniformly by the charge roller 25. Thereby, an electrostatic latent image is formed on the photosensitive drum 23. The electrostatic latent image formed on the photosensitive drum 23 is sequentially visualized as a toner image by toner supplied from the developing roller 27.

The sheet feeding apparatus 10 includes a sheet feed tray 11 inserted to a sheet feed port opened to a right side portion of the printer body 2, a feed roller 12 coming into contact with the sheet supported on the sheet feed tray 11 and feeding the sheet, and a separation pad 13 that abuts against the feed roller 12. While forming an image, the sheet S is fed one sheet at a time from the uppermost sheet S by the feed roller 12 and the separation pad 13. The sheet S sent out by the feed roller 12 and the separation pad 13 is conveyed to a registration roller pair 15. Skewing of the sheet S is corrected by the registration roller pair 15, and the sheet S is sent to a transfer nip portion formed by the photosensitive drum 23 and the transfer roller 28 at a matched timing with the advancement of the image forming process by the image forming unit 20. At the transfer nip portion, toner on the photosensitive drum 23 is electrostatically transferred by transfer bias applied to the transfer roller 28.

Figure 5:
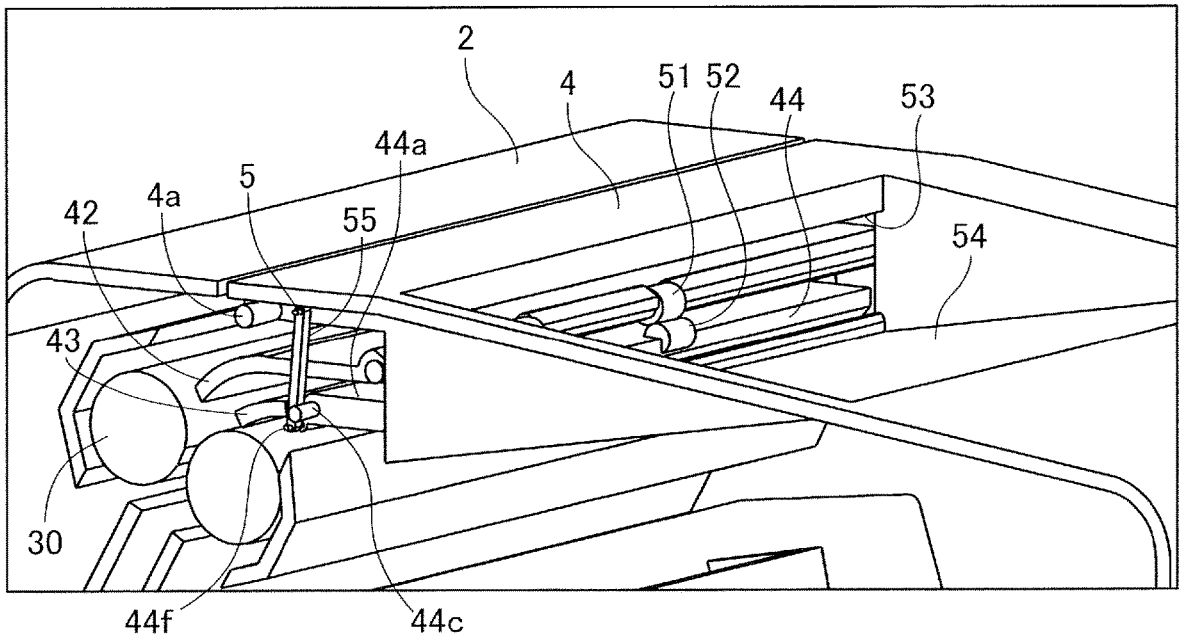
FIG. 5 is a perspective cross-sectional view illustrating a driven roller holder in a state where the opening/closing cover is in the closed state.

The sheet S to which toner image has been transferred is separated from the photosensitive drum 23, and the fixing roller pair 30 arranged above the process cartridge 22 applies heat and pressure, by which the toner image is fixed. Thereafter, the sheet S is conveyed to a sheet discharge apparatus 40 that is arranged above the process cartridge 22 and on the right side of the fixing roller pair 30. The sheet discharge apparatus 40 includes a drive roller 51 serving as a second rotary member driven to rotate by a driving source such as a motor, and a sheet discharge roller pair 50 serving as a sheet discharge portion configured of an idler roller 52 serving as a first rotary member that abuts against the drive roller 51 and driven to rotate thereby. The sheet S discharged from the fixing roller pair 30 is guided by a conveyance path 41 to the sheet discharge roller pair 50. The sheet S is sandwiched between the drive roller 51 and the idler roller 52 of the sheet discharge roller pair 50, and as illustrated in FIG. 5, discharged through a sheet discharge port 53 formed on the opening/closing cover 4 to an exterior of the printer body 2, and supported on a tray 54 serving as a supporting portion formed on the opening/closing cover 4.

As illustrated in FIG. 2, the opening/closing cover 4 is supported pivotably with respect to the printer body 2 around a rotation shaft 4*a* provided on a left end thereof, and a recessed portion 4*b* is formed on a right end thereof. According to the printer 1, in a state where the opening/closing cover 4 is closed as illustrated in FIG. 1, the user can hold the recessed portion 4*b* and lift the opening/closing cover 4 upward, by which the opening/closing cover 4 is opened as illustrated in FIG. 2 and the opening portion 3 is exposed to the exterior.

According to the printer 1 of the present disclosure, the process cartridge 22 is attached inside the printer body 2 along a movement locus L. The movement locus L is a passage area through which the process cartridge 22 passes when being attached to and detached from the printer body 2. A guide rail 29 serving as a guide portion that guides a rotation shaft 23*a* of the photosensitive drum 23 in sliding motion is fixed inside the printer body 2. The guide rail 29 is extended to an upper right side toward the opening portion 3 from the position of the rotation shaft 23*a* in a state where the process cartridge 22 is attached, and while attaching and detaching the process cartridge 22, the guide rail 29 guides the process cartridge 22 along the movement locus L.

Details of Sheet Discharge Apparatus

Figure 3:
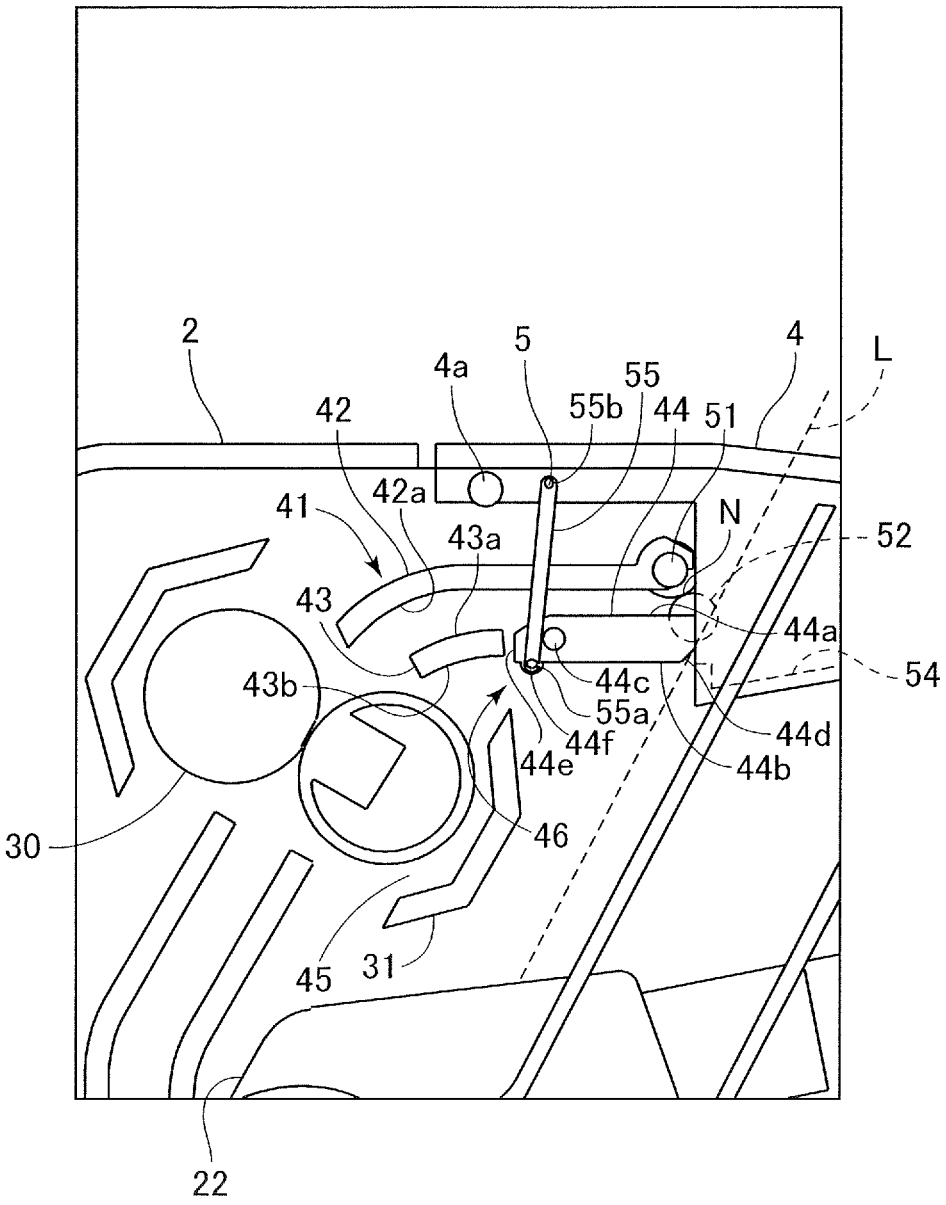
FIG. 3 is a view illustrating a sheet discharge roller pair in a state where the opening/closing cover is in a closed state.
Figure 4:
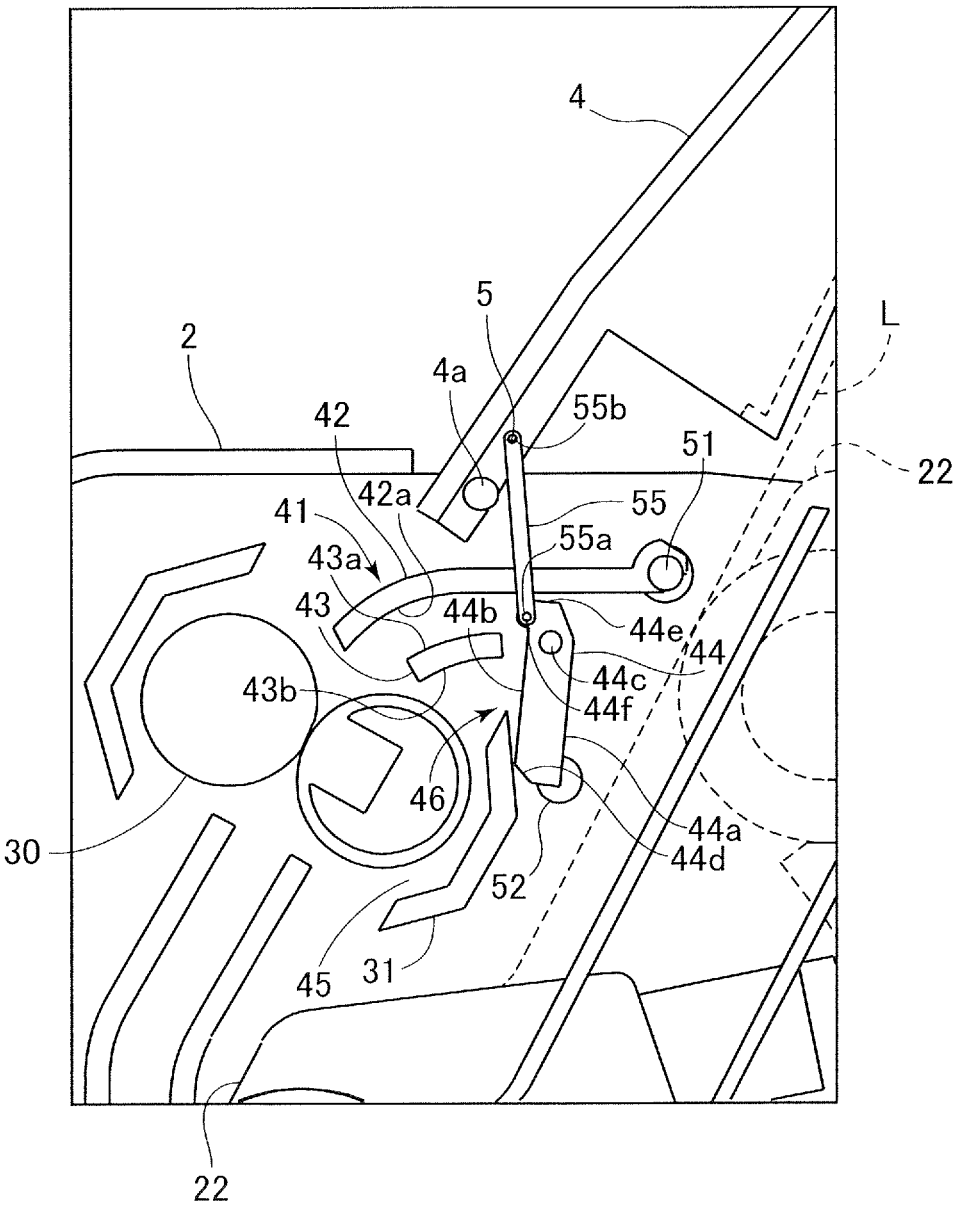
FIG. 4 is a view illustrating a sheet discharge roller pair in a state where the opening/closing cover is in the opened state.
Figure 6:
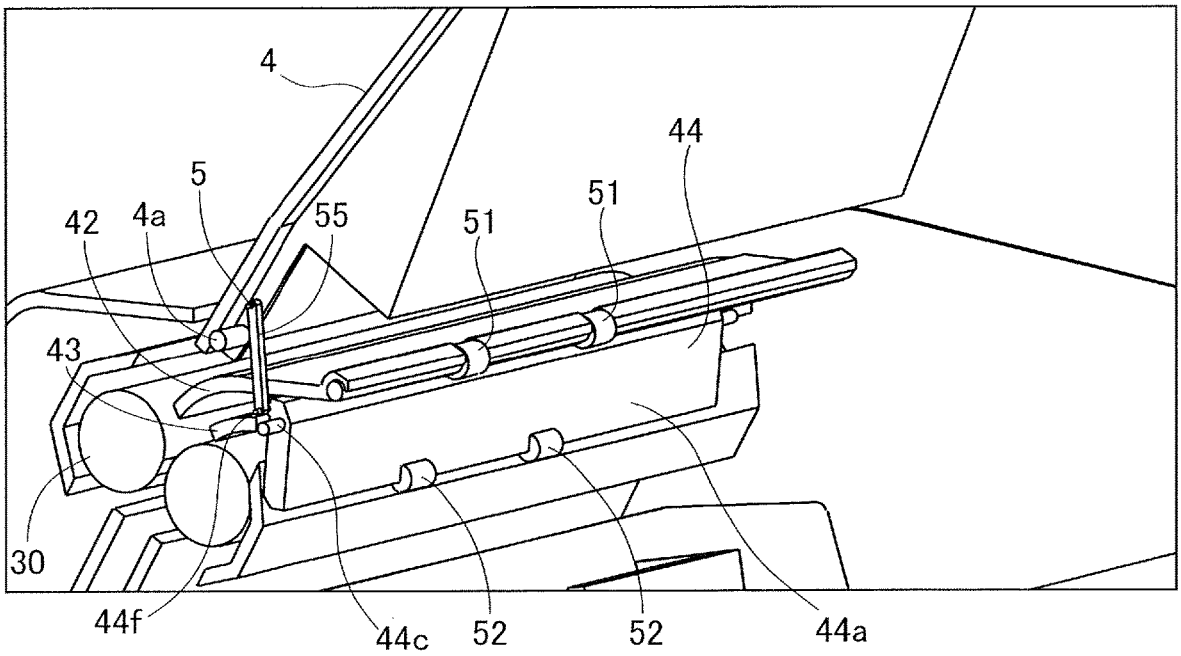
FIG. 6 is a perspective cross-sectional view illustrating the driven roller holder in a state where the opening/closing cover is in the opened state.

Next, details of the sheet discharge apparatus 40 will be described with reference to FIGS. 3 through 6. FIGS. 3 and 4 are side views illustrating the sheet discharge roller pair 50 in a closed state where the opening/closing cover 4 is closed and in an opened state where it is opened, and FIGS. 5 and 6 are perspective views thereof. In the following description, similarly, the positional relationships of up, down, right, left, front and rear are described based on the state in which the printer 1 with the opening/closing cover 4 closed is viewed from a side, that is, viewpoint of FIGS. 1 and 3.

The conveyance path 41 is composed of a guide portion 42 serving as an opposing guide that opposes to a second side on which image is not formed of the sheet S being conveyed, a guide portion 43 opposed to a first side on which image is formed of the sheet S being conveyed, and a driven roller holder 44 serving as a supporting portion. That is, a portion of the conveyance path 41 is formed of the driven roller holder 44 and the guide portion 42. The driven roller holder 44 is arranged downstream of the guide portion 43 in a sheet discharge direction. Further, a wall portion 31 that partially covers a right side of the fixing roller pair 30 is arranged below the guide portion 43 and the driven roller holder 44. The wall portion 31 is not in contact with the guide portion 43 and the driven roller holder 44. In the printer 1, the conveyance path 41 and a gap 46 is provided as a communicating portion communicating the opening portion 3 and a space 45 in which the fixing roller pair 30 is arranged. The gap 46 is provided between a lower surface 43*b* of the guide portion 43 and a lower surface 44*b* of the driven roller holder 44, and allows the heat generated from the fixing roller pair 30 to escape.

The guide portion 42 is designed to extend to the upper right side from the fixing roller pair 30 and then to extend rightward in midway, and the drive roller 51 is supported rotatably at a right end which is a downstream end in the sheet discharge direction. The guide portion 43 is formed to extend rightward from the fixing roller pair 30. The driven roller holder 44 is pivotably supported on the printer body 2 around a rotation shaft 44*c* arranged on a right side of the guide portion 43, and it is shaped to extend in right and left directions from the rotation shaft 44*c*. The idler roller 52 is supported rotatably at a right end 44*d* serving as a first end portion of the driven roller holder 44.

The driven roller holder 44 is movable between an operating position serving as a first position in which the idler roller 52 overlaps with the movement locus L when viewed in the axial direction of the idler roller 52, and a released position serving as a second position in which the idler roller 52 does not overlap with the movement locus L, as illustrated in FIG. 4. In a state where the driven roller holder 44 is positioned at the operating position, the idler roller 52 is urged toward the drive roller 51 by a spring (not shown), abuts against the drive roller 51, and forms a nip portion N. The sheet S discharged from the fixing roller pair 30 is guided by the lower surface 42*a* of the guide portion 42, an upper surface 43*a* of the guide portion 43, and an upper surface 44*a* of the driven roller holder 44 and conveyed to the nip portion N.

The driven roller holder 44 pivots in a clockwise direction from the operating position to move to a released position, and at the released position, separates the idler roller 52 from the drive roller 51. Further, the driven roller holder 44 is designed such that when it is positioned at the released position, a gap formed between a left end 44*e* and the lower surface 42*a* becomes wider than a thickness of the sheet S. Further, the driven roller holder 44 is designed such that the distance from the rotation shaft 44*c* to the left end 44*e* is set longer than the distance from the rotation shaft 44*c* to the upper surface 44*a*.

The driven roller holder 44 and the opening/closing cover 4 are connected via a holder link 55 serving as a connecting portion. Holes 55*a* and 55*b* are formed on either end of the holder link 55. A shaft portion 44*f* fixed to the left end 44*e* of the driven roller holder 44 is pivotably connected to the hole 55*a*, and a shaft portion 5 fixed to a position rightward of the rotation shaft 4*a* is pivotably connected to the hole 55*b*.

By operation of the holder link 55, the driven roller holder 44 is positioned at the operating position when the opening/closing cover 4 is in the closed state. In an opening operation in which the opening/closing cover 4 is opened from the closed state, the holder link 55 moves upward together with the opening/closing cover 4 and the left end 44*e* of the driven roller holder 44 is pulled by the holder link 55 and pivots upward. The driven roller holder 44 pivots in a clockwise direction in conjunction with the opening operation of the opening/closing cover 4, and the right end 44*d* pivots to the lower left direction together with the idler roller 52. Thereby, the driven roller holder 44 retreats to a released position where the idler roller 52 does not overlap with the movement locus L when viewed in the axial direction of the idler roller 52.

When the driven roller holder 44 moves from the operating position to the released position, the left end 44*e* serving as the second end portion approaches the lower surface 42*a* of the guide portion 42. Since the distance from the rotation shaft 44*c* to the left end 44*e* is longer than the distance from the rotation shaft 44*c* to the upper surface 44*a* in the driven roller holder 44, the distance between the guide portion 42 and the driven roller holder 44 is narrowed in conjunction with the opening operation of the opening/closing cover 4, and the conveyance path 41 is narrowed. In addition, in the printer 1, the driven roller holder 44 pivots in a clockwise direction from the operating position in conjunction with the opening operation of the opening/closing cover 4, so that the driven roller holder 44 approaches the wall portion 31 and the gap 46 is narrowed.

In the closing operation of closing the opening/closing cover 4 from the opened state, the holder link 55 moves downward together with the opening/closing cover 4, and the left end 44*e* of the driven roller holder 44 is pressed by the holder link 55 and pivots downward. The driven roller holder 44 pivots in a counterclockwise direction in conjunction with the closing operation of the opening/closing cover 4, and the right end 44*d* thereof pivots to the upper right together with the idler roller 52. In a state where the opening/closing cover 4 is in the closed state, the driven roller holder 44 is positioned at the operating position.

As described, according to the printer 1, since the idler roller 52 retreats to a position where it does not overlap with the movement locus L in conjunction with the opening operation of the opening/closing cover 4, the process cartridge 22 can be attached and detached without interfering with the idler roller 52. Accordingly, the printer body 2 of the printer 1 can be downsized without interfering with the replacing operation of the process cartridge 22. Further, freedom of design of the printer 1 can be improved since freedom in which the movement locus L is arranged in the printer 1 is increased.

Since the idler roller 52 retreats from the operating position in conjunction with the opening operation of the opening/closing cover 4, it is separated from the drive roller 51. Thus, the user can easily remove the sheet, i.e., jammed sheet, jammed in the conveyance path extending from the fixing roller pair 30 to the sheet discharge roller pair 50.

According to the printer 1, the conveyance path 41 is narrowed in conjunction with the opening operation of the opening/closing cover 4, such that the problem of the user erroneously touching a highly heated fixing roller pair 30 through the conveyance path 41 can be prevented. Further, in a state where the driven roller holder 44 is positioned at the released position, the gap between the left end 44*e* and the lower surface 42*a* is formed to be wider than the thickness of the sheet S, such that hindrance of removal operation of a jammed sheet by the user can be prevented. Further, according to the printer 1, the gap 46 is narrowed in conjunction with the opening operation of the opening/closing cover 4, such that it becomes possible to prevent the user from erroneously touching a highly heated fixing roller pair 30 through the gap 46. That is, by moving from the operating position to the released position, the driven roller holder 44 partitions the space between the fixing roller pair 30 and the movement locus L and prevents the user from erroneously touching the fixing roller pair 30.

Further, in the first embodiment, the driven roller holder 44 is configured to move to the released position by pivoting in a counterclockwise direction from the operating position, but the present invention is not limited to this example. The driven roller holder 44 can be configured to pivot in the clockwise direction in conjunction with the opening operation of the opening/closing cover 4, as long as the idler roller 52 pivots to a position where it is not overlapped with the movement locus L in conjunction with the opening operation of the opening/closing cover 4. As for the shape of the driven roller holder 44, as long as the idler roller 52 pivots to a position where it is not overlapped with the movement locus L in conjunction with the opening operation of the opening/closing cover 4, the shape is not limited to that illustrated in the present embodiment.

Further, in the first embodiment, the conveyance path 41 is formed of the guide portions 42 and 43 and the driven roller holder 44, but the present invention is not limited to this configuration, and the conveyance path 41 can be formed only of the guide portions 42 and 43. In this case, according to the printer 1, a portion of the driven roller holder 44 enters the conveyance path 41 and narrows the conveyance path 41 in conjunction with the opening operation of the opening/closing cover 4. The printer 1 should merely have the driven roller holder 44 narrow the conveyance path 41 in conjunction with the opening operation of the opening/closing cover 4, and the configuration is not limited to that illustrated in the present embodiment.

In the first embodiment, the driven roller holder 44 is connected mechanically to the opening/closing cover 4 via the holder link 55, but the present invention is not limited to this example. For example, a sensor for detecting opening and closing of the opening/closing cover 4 and an actuator for moving the driven roller holder 44 to the operating position and the released position can be used. It is possible to move the driven roller holder 44 from the operating position to the released position by an actuator when the sensor detects that the opening/closing cover 4 has been opened.

Further, the driven roller holder 44 can be pivoted manually after the user opens the opening/closing cover 4, instead of having the holder link 55 mechanically connect the driven roller holder 44 and the opening/closing cover 4. Further, the driven roller holder 44 can be designed to be pushed from the operating position to the released position by the process cartridge 22 being attached and removed.

Second Embodiment

Figure 7:
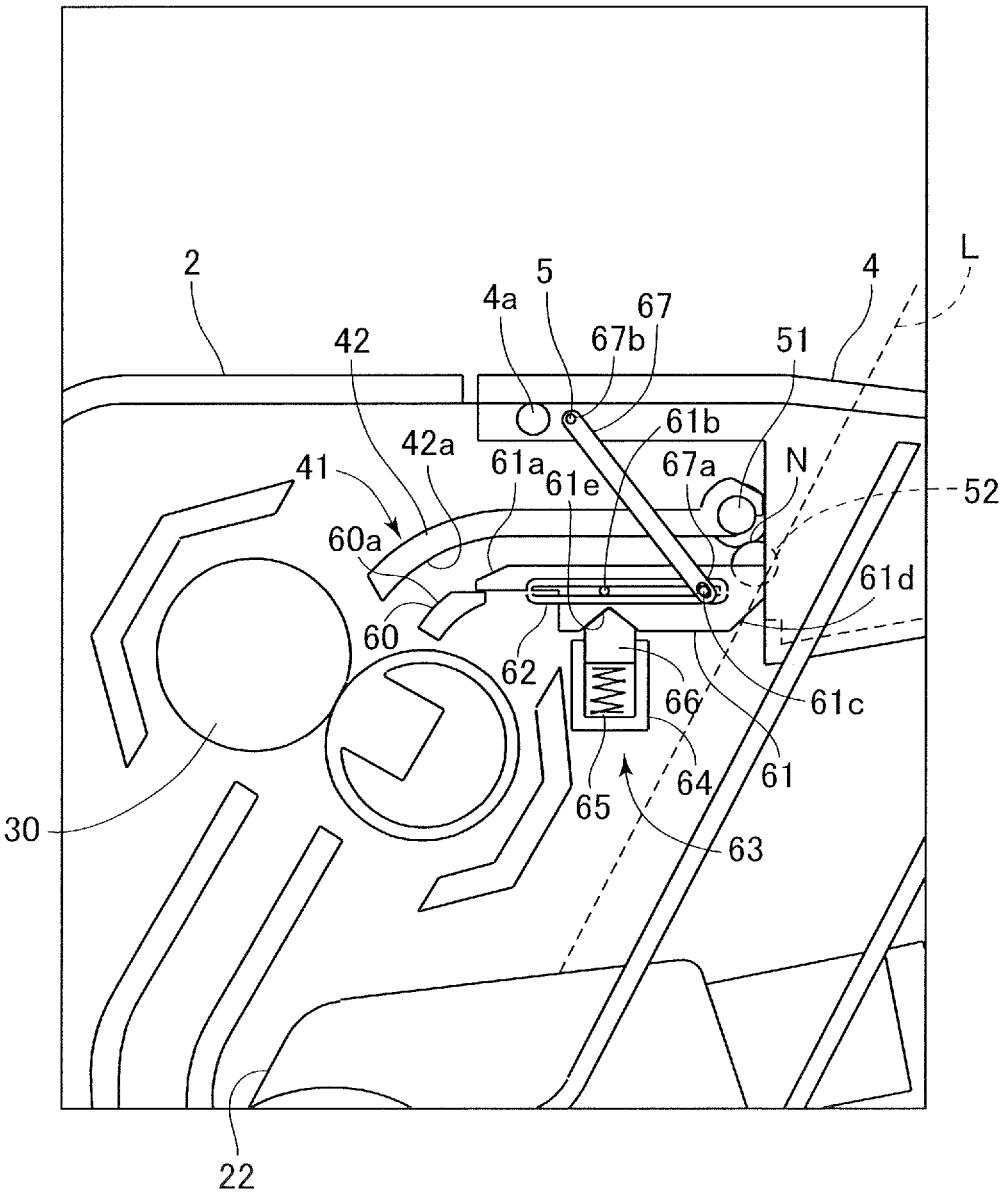
FIG. 7 is a view illustrating a sheet discharge roller pair according to a second embodiment.
Figure 8:
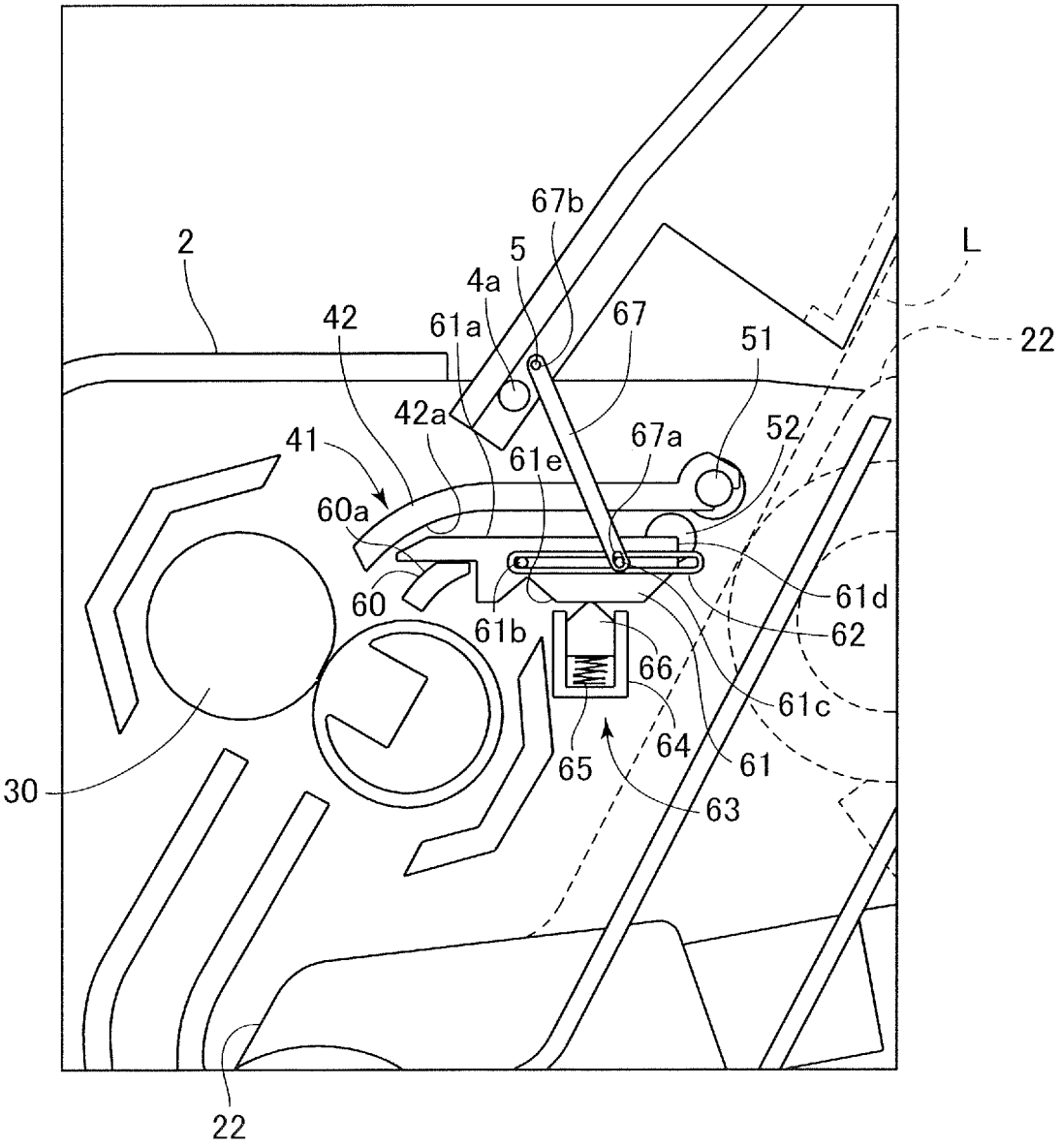
FIG. 8 is a view illustrating a sheet discharge roller pair in a state where the opening/closing cover is in the opened state.

Next, a second embodiment will be described. Similar configurations as the first embodiment are either not shown in the drawing or denoted with the same reference numbers and descriptions thereof are omitted. As illustrated in FIGS. 7 and 8, the conveyance path 41 includes a guide portion 42, a guide portion 60 arranged below the sheet S being conveyed, and a driven roller holder 61 serving as a supporting portion arranged downstream of the guide portion 60 in the sheet discharge direction. FIGS. 7 and 8 are side views illustrating the sheet discharge roller pair 50 in a state where the opening/closing cover 4 is closed or opened. In the following description of the second embodiment, positional relationships of up, down, right, left, front and rear are described based on the state in which the printer 1 with the opening/closing cover 4 closed is viewed from a side, that is, viewpoint of FIG. 7.

An idler roller 52 is rotatably supported via a spring (not shown) on a right end 61*d* of the driven roller holder 61. Further, the driven roller holder 61 includes bosses 61*b* and 61*c* that are connected slidably to a long hole 62 extending in right and left directions formed on the printer body 2, by which the driven roller holder is supported slidably in right and left directions with respect to the printer body 2. The driven roller holder 61 is movable between an operating position serving as a first position at which the idler roller 52 overlaps with the movement locus L when viewed in the axial direction of the idler roller 52, and a released position serving as a second position at which the idler roller 52 does not overlap with the movement locus L, as illustrated in FIG. 8. In a state where the driven roller holder 61 is positioned at the operating position, the idler roller 52 is urged toward the drive roller 51 by a spring, abuts against the drive roller 51, and forms a nip portion N. The sheet S discharged from the fixing roller pair 30 is guided by the lower surface 42*a* of the guide portion 42, an upper surface 60*a* of the guide portion 60, and an upper surface 61*a* of the driven roller holder 61 and conveyed to the nip portion N.

The driven roller holder 61 moves leftward from the operating position to thereby move to the released position, and at the released position, separates the idler roller 52 from the drive roller 51. Further, in a state where the driven roller holder 61 is positioned at the released position, the gap between the upper surface 61*a* and the lower surface 42*a* is wider than the thickness of the sheet S. The upper surface 61*a* is closer to the lower surface 42*a* when the driven roller holder 61 is positioned at the released position than when at the operating position.

A plunger 63 that pushes the driven roller holder 61 from below is provided in the printer 1. The plunger 63 includes a main body portion 64 fixed to the printer body 2, a pin portion 66 that is movable in up and down directions with respect to the main body portion 64, and a spring 65 arranged between the main body portion 64 and the pin portion 66 and urging the pin portion 66 upward. An engagement groove 61*e* that engages with the pin portion 66 at the operating position is formed on the driven roller holder 61.

The driven roller holder 61 and the opening/closing cover 4 are connected via a holder link 67 serving as the connecting portion. A long hole 67*a* and a hole 67*b* are formed on either end of the holder link 67. A boss 61*c* is pivotably and slidably connected to the long hole 67*a*, and the shaft portion 5 is pivotably connected to the hole 67*b*.

According to this configuration, the driven roller holder 61 is positioned at the operating position when the opening/closing cover 4 is in the closed state. In an opening operation of the opening/closing cover 4, the holder link 67 moves in the upper left direction together with the opening/closing cover 4 and the boss 61*c* is pulled by the holder link 67. The driven roller holder 61 is pulled leftward through the boss 61*c*, by which the pin portion 66 is disengaged from the engagement groove 61*e* and the driven roller holder 61 moves to the released position in conjunction with the opening operation of the opening/closing cover 4. Thereby, according to the printer 1, the idler roller 52 retreats to a position where the idler roller 52 does not overlap with the movement locus L when viewed in the axial direction of the idler roller 52. Further according to the printer 1, the upper surface 61*a* approaches the lower surface 42*a* in conjunction with the opening operation of the opening/closing cover 4 and the conveyance path 41 is narrowed.

In the closing operation of the opening/closing cover 4, the holder link 67 moves to the lower right direction together with the opening/closing cover 4, and the boss 61*c* is pushed by the holder link 67. The driven roller holder 61 moves rightward in conjunction with the closing direction of the opening/closing cover 4, and by having the pin portion 66 engage with the engagement groove 61*e*, the driven roller holder 61 is positioned at the operating position.

As described, according to the printer 1 of the second embodiment, since the idler roller 52 retreats to a position where it does not overlap with the movement locus L in conjunction with the opening operation of the opening/closing cover 4, the process cartridge 22 can be attached and detached without interfering with the idler roller 52. Accordingly, the printer body 2 of the printer 1 can be downsized without interfering with the replacing operation of the process cartridge 22. Further, freedom of design of the printer 1 can be improved since freedom in which the movement locus L is arranged in the printer 1 is increased.

Since the idler roller 52 retreats from the operating position in conjunction with the opening operation of the opening/closing cover 4, it is separated from the drive roller 51 and retreats from a position where it is in pressure contact with the drive roller 51. Thus, the user can easily remove the sheet, i.e., jammed sheet, jammed in the conveyance path extending from the fixing roller pair 30 to the sheet discharge roller pair 50.

According to the printer 1, the conveyance path 41 is narrowed in conjunction with the opening operation of the opening/closing cover 4, such that the problem of the user erroneously touching a highly heated fixing roller pair 30 through the conveyance path 41 can be prevented. Further, in a state where the driven roller holder 61 is positioned at the released position, the gap between the upper surface 61*a* and the lower surface 42*a* is formed to be wider than the thickness of the sheet S, such that removal operation of a jammed sheet by the user will not be hindered.

Further, in the second embodiment, the driven roller holder 61 is configured to move to the released position by moving leftward from the operating position, but the present invention is not limited to this example. The driven roller holder 61 can be configured to move rightward in conjunction with the opening operation of the opening/closing cover 4, as long as the idler roller 52 moves to a position where it is not overlapped with the movement locus L by the opening operation of the opening/closing cover 4. As for the shape of the driven roller holder 61, as long as the idler roller 52 moves to a position where it is not overlapped with the movement locus L in conjunction with the opening operation of the opening/closing cover 4, the shape is not limited to that illustrated in the present embodiment.

In the second embodiment, the conveyance path 41 is formed of the guide portions 42 and 60 and the driven roller holder 61, but the present invention is not limited to this embodiment, and the conveyance path 41 can be formed only of the guide portions 42 and 60. In this case, according to the printer 1, a portion of the driven roller holder 61 enters the conveyance path 41 and narrows the conveyance path 41 in conjunction with the opening operation of the opening/closing cover 4. The printer 1 should merely have the driven roller holder 61 narrow the conveyance path 41 in conjunction with the opening operation of the opening/closing cover 4, and the configuration is not limited to that illustrated in the present embodiment.

Further according to the second embodiment, the printer 1 is configured to include the plunger 63 that positions the driven roller holder 61 that has reached the operating position, but the present invention is not limited to this configuration, and the driven roller holder 61 may also be positioned using a magnet. The printer 1 should merely be configured to enable positioning of the driven roller holder 61 having reached the operating position, and the configuration is not limited to that illustrated in the present embodiment.

Third Embodiment

Figure 9:
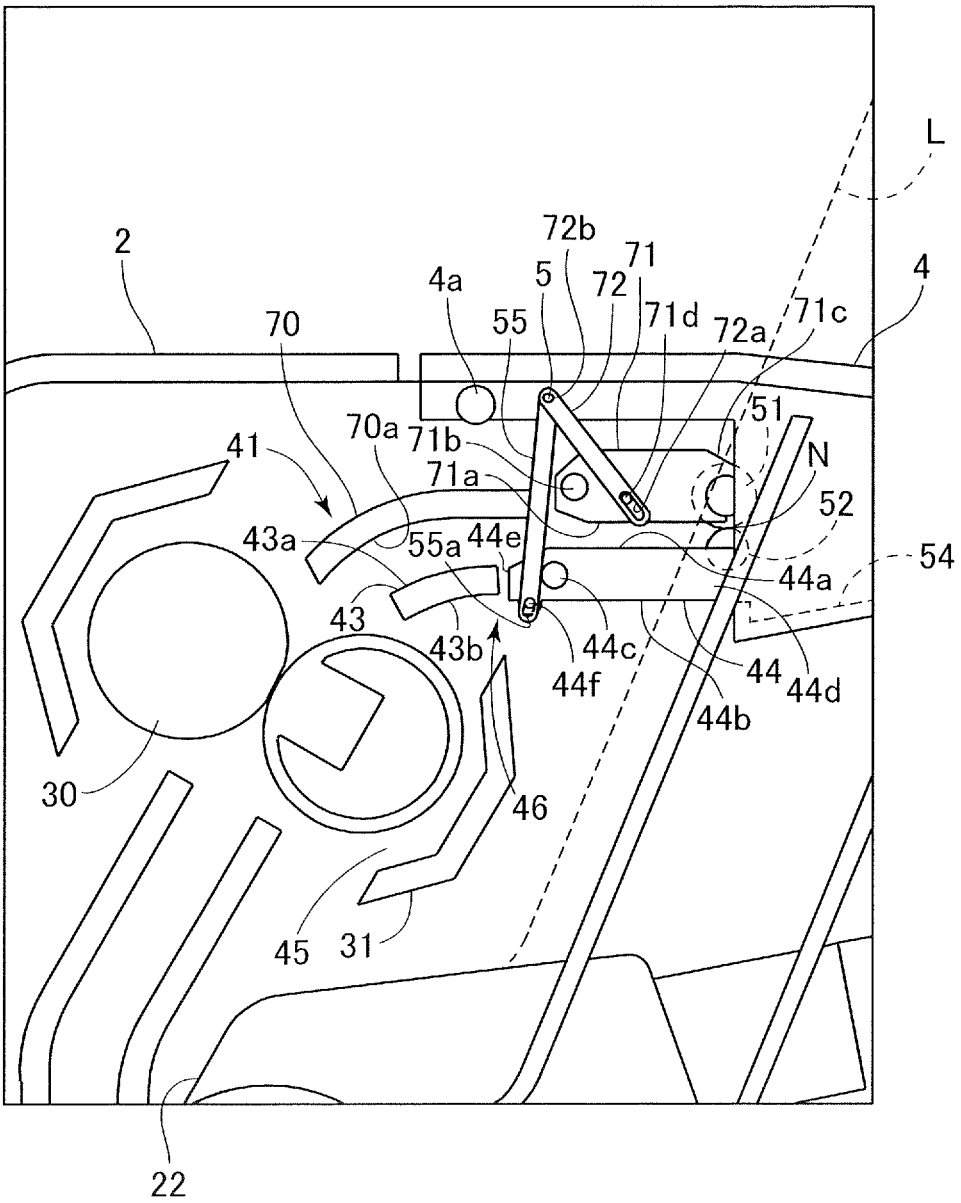
FIG. 9 is a view illustrating a sheet discharge roller pair according to a third embodiment.
Figure 10:
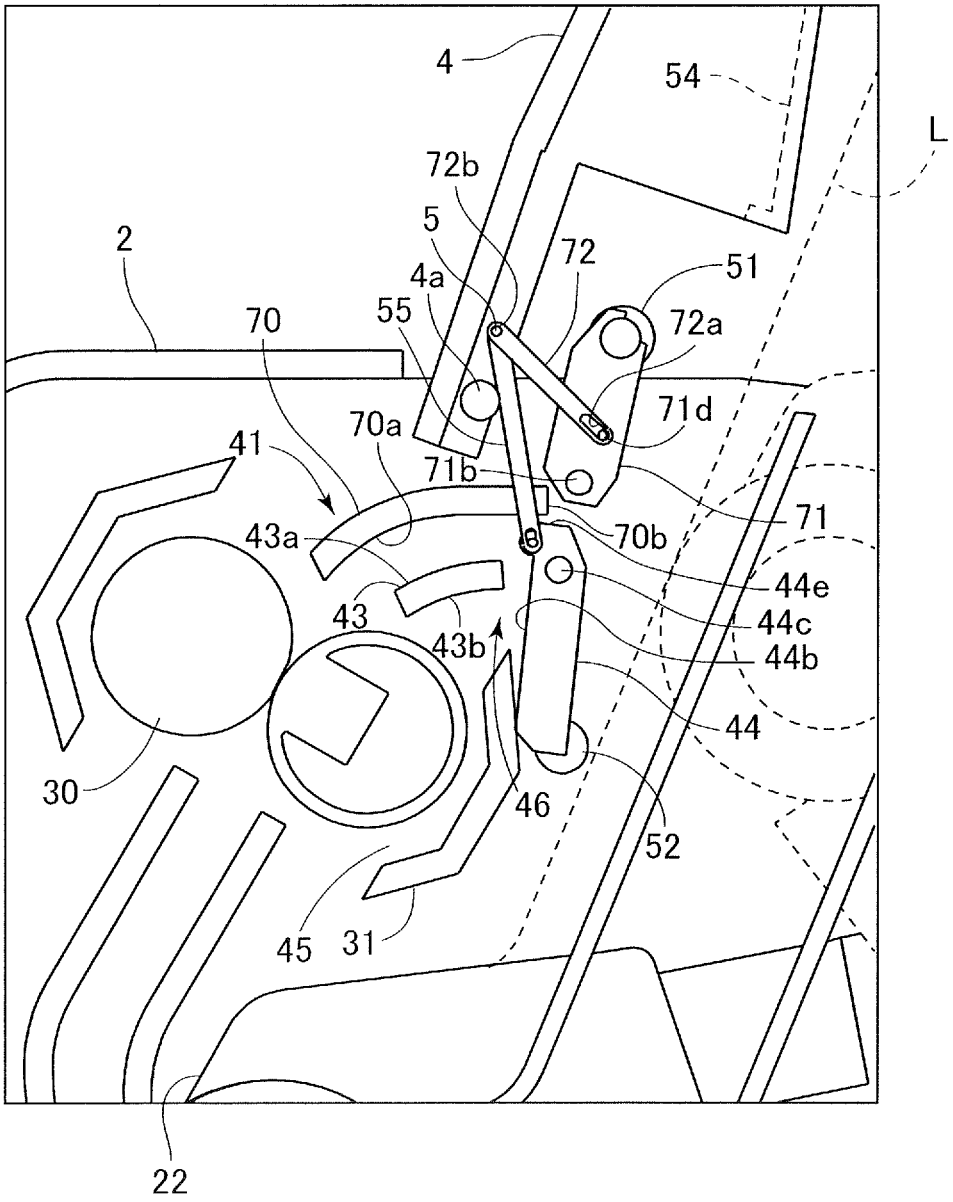
FIG. 10 is a view illustrating a sheet discharge roller pair in a state where the opening/closing cover is in the opened state.

Next, a third embodiment will be described. Similar configurations as the first embodiment are either not shown in the drawing or denoted with the same reference numbers and descriptions thereof are omitted. As illustrated in FIGS. 9 and 10, the conveyance path 41 includes a guide portion 70 arranged below the sheet S being conveyed, a guide portion 43, a driven roller holder 44 serving as a first supporting portion, and a drive roller holder 71 serving as a second supporting portion. FIGS. 9 and 10 are side views illustrating the sheet discharge roller pair 50 in a state where the opening/closing cover 4 is closed or opened. In the following description of the third embodiment, positional relationships of up, down, right, left, front and rear are described based on the state in which the printer 1 with the opening/closing cover 4 closed is viewed from a side, that is, viewpoint of FIG. 9.

The guide portion 70 is formed to extend to the upper right direction from the fixing roller pair 30, and in midway, to extend rightward. Further, a right end 70*b* of the guide portion 70 is arranged rightward of the left end 44*e* of the driven roller holder 44. Therefore, the guide portion 70 is formed such that the left end 44*e* approaches the guide portion 70 in conjunction with the opening operation of the opening/closing cover 4. The drive roller holder 71 is supported pivotably to the printer body 2 through a rotation shaft 71*b* arranged on a right side of the guide portion 70 and is shaped to extend rightward from the rotation shaft 71*b*. The drive roller 51 is supported rotatably on a right end 71*c* of the drive roller holder 71.

The drive roller holder 71 is movable between a drive-side operating position serving as a third position where the drive roller 51 overlaps with the movement locus L when viewed in the axial direction of the idler roller 52 and a drive-side released position serving as a fourth position where the drive roller 51 does not overlap with the movement locus L, as illustrated in FIG. 10. In a state where the driven roller holder 44 is positioned at the operating position and the drive roller holder 71 is positioned at the drive-side operating position, the idler roller 52 abuts against the drive roller 51 and forms a nip portion N. The sheet S discharged from the fixing roller pair 30 is guided by a lower surface 70*a* of the guide portion 70, an upper surface 43*a*, an upper surface 44*a* and a lower surface 71*a* of the drive roller holder 71 and conveyed to the nip portion N.

The drive roller holder 71 moves to the drive-side released position by pivoting in a counterclockwise direction from the drive-side operating position. In the printer 1, the idler roller 52 and the drive roller 51 are separated by the driven roller holder 44 moving to the released position and the drive roller holder 71 moving to the drive-side released position.

The drive roller holder 71 and the opening/closing cover 4 are connected via a holder link 72. A long hole 72*a* and a hole 72*b* are formed on either end of the holder link 72. A shaft portion 71*d* that is fixed to a position rightward of the rotation shaft 71*b* is pivotably and slidably connected to the long hole 72*a*, and the shaft portion 5 is pivotably connected to the hole 72*b*.

According to this configuration, the drive roller holder 71 is positioned at the drive-side operating position when the opening/closing cover 4 is in the closed state. In an opening operation of the opening/closing cover 4, the holder link 72 moves upward together with the opening/closing cover 4 and the shaft portion 71*d* is pivoted upward by being pulled by the holder link 72. The drive roller holder 71 is pivoted in the counterclockwise direction in conjunction with the opening operation of the opening/closing cover 4, by which the right end 71*c* is pivoted in the upper left direction together with the drive roller 51. Thereby, the drive roller holder 71 retreats to a drive-side released position where the drive roller 51 does not overlap with the movement locus L.

In the closing operation of the opening/closing cover 4, the holder link 72 moves downward together with the opening/closing cover 4, and the shaft portion 71*d* is pushed by the holder link 72 and pivots downward. The drive roller holder 71 pivots in the clockwise direction in conjunction with the closing operation of the opening/closing cover 4, by which the right end 71*c* is pivoted to the lower right direction together with the drive roller 51. Then, when the opening/closing cover 4 is in the closed state, the drive roller holder 71 is positioned at the drive-side operating position.

As described, according to the printer 1, since the drive roller 51 and the idler roller 52 retreat to a position not overlapped with the movement locus L in conjunction with the opening operation of the opening/closing cover 4, the process cartridge 22 can be attached and detached without interfering with the drive roller 51 and the idler roller 52. Accordingly, the printer body 2 of the printer 1 can be downsized without interfering with the replacing operation of the process cartridge 22. Further, freedom of design of the printer 1 can be improved since freedom in which the movement locus L is arranged in the printer 1 is increased. Since the drive roller 51 and the idler roller 52 are respectively moved to be separated from each other in conjunction with the opening operation of the opening/closing cover 4, the user can easily remove the sheet, i.e., jammed sheet, jammed in the conveyance path extending from the fixing roller pair 30 to the sheet discharge roller pair 50.

In the first to third embodiments, the idler roller 52 is connected to the driven roller holder 44 and 61, but the present invention is not limited to this configuration, and a configuration where the drive roller 51 is connected thereto can be adopted. That is, the drive roller 51 and the idler roller 52 can be configured to be arranged at switched positions as the arrangement according to the present embodiment. Further, the first to third embodiments may be combined as required.

In the first to third embodiments, the driven roller holder 44 or 61 is arranged below the sheet S being conveyed, but the present invention is not limited to this configuration, and they can also be arranged above the sheet S being conveyed. The driven roller holder 44 or 61 should be configured so that the idler roller 52 moves to a position not overlapped with the movement locus L in conjunction with the opening operation of the opening/closing cover 4, and the arrangement thereof is not limited to that illustrated in the present embodiments.

Further according to the first to third embodiments, the process cartridge 22 is configured to be attached to and detached from the printer 1, but the present invention is not limited to this configuration, and other cartridges such as the drum cartridge 24 or the developer cartridge 26 can be designed attachably and detachably. For example, only the developer cartridge 26 serving as a cartridge can be designed attachably and detachably with respect to the printer body 2. In that case, the printer 1 should be configured so that the idler roller 52 moves to a position not overlapped with the movement locus L of the other cartridge in conjunction with the opening operation of the opening/closing cover 4. It is noted that the photosensitive drum 23, serving as a photoreceptor, included in the drum cartridge 24 is not limited to be constituted of a drum, and may be constituted of a belt and the like. It is noted that the developing roller 27, serving as a developing member, included in the developer cartridge 26 is not limited to be constituted of a roller, and may be constituted of a belt and the like.

According further to the first to third embodiments, the opening portion 3 is formed above the printer body 2 in the printer 1, but the present invention is not limited to this configuration, and a configuration can be adopted where the opening portion 3 is formed on a side portion of the printer body 2 and the opening/closing cover 4 is arranged to cover the opening portion 3. Moreover, the opening/closing cover 4 is supported pivotably with respect to the printer body 2 according to the first to third embodiments, but the present invention is not limited to this configuration, and the opening/closing cover 4 can be formed slidably with respect to the printer body 2.

In the third embodiment, the printer 1 is configured to include the driven roller holder 44 supported pivotably with respect to the printer body 2, but the present invention is not limited to this configuration, and the printer 1 can be configured to include the driven roller holder 61 supported slidably.

In the third embodiment of the printer 1, the drive roller holder 71 is configured to pivot in the counterclockwise direction in conjunction with the opening operation of the opening/closing cover 4, but the present invention is not limited to this configuration, and the drive roller holder 71 can be configured to pivot in the clockwise direction. The printer 1 should merely be configured such that the drive roller 51 and the idler roller 52 respectively move away from each other in conjunction with the opening operation of the opening/closing cover 4.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-075511, filed Apr. 10, 2018, which is hereby incorporated by reference herein in its entirety.

What is claimed is:

1. An image forming apparatus comprising:

an apparatus body comprising an opening portion;

a cover supported in an openable and closable manner on the apparatus body and configured to cover the opening portion of the apparatus body when in a closed state;

a cartridge configured to be detached from the apparatus body in a detaching direction through the opening portion, the cartridge comprising a photoreceptor configured to bear a toner image;

a sheet discharge portion comprising a first rotary member and a second rotary member configured to nip and discharge a sheet on which the toner image has been transferred;

a driving source configured to drive the second rotary member to rotate, the first rotary member being driven to rotate by rotation of the second rotary member; and a supporting portion configured to rotatably support the first rotary member and move, when viewed in an axial direction of the first rotary member, to a first position where the first rotary member overlaps with a movement locus of the cartridge, and to a second position where the first rotary member is positioned upstream of the second rotary member with respect to the detaching direction and where the first rotary member does not overlap with the movement locus, the movement locus being a passage area through which the cartridge passes while being detached from the apparatus body.

2. The image forming apparatus according to claim 1, wherein the supporting portion is positioned at the first position when the cover is in the closed state, and is moved from the first position to the second position when the cover is opened from the closed state.

3. The image forming apparatus according to claim 2, further comprising a connecting portion that connects the cover and the supporting portion, and moves the supporting portion in conjunction with the cover.

4. The image forming apparatus according to claim 1, wherein the supporting portion abuts the first rotary member against the second rotary member to form a nip portion at the first position, and separates the first rotary member from the second rotary member at the second position.

5. The image forming apparatus according to claim 1, wherein the supporting portion is supported pivotably with respect to the apparatus body.

6. The image forming apparatus according to claim 1, wherein the supporting portion is supported slidably with respect to the apparatus body.

7. The image forming apparatus according to claim 2, wherein the supporting portion is a first supporting portion, and the image forming apparatus further comprises a second supporting portion configured to rotatably support the second rotary member and move, when viewed in an axial direction of the second rotary member, to a third position where the second rotary member overlaps with the movement locus and to a fourth position where the second rotary member does not overlap with the movement locus.

8. The image forming apparatus according to claim 7, wherein the second supporting portion is positioned at the third position when the cover is in the closed state, and the second supporting portion is moved from the third position to the fourth position when the cover is opened from the closed state.

9. The image forming apparatus according to claim 8, wherein the first and second supporting portions are respectively moved such that the first rotary member and the second rotary member abut against each other when the cover is in the closed state, and are respectively moved such that the first rotary member and the second rotary member are separated from each other when the cover is opened from the closed state.

10. The image forming apparatus according to claim 1, further comprising a guide portion that guides the cartridge along the movement locus.

11. The image forming apparatus according to claim 10, wherein a rotation shaft of the photoreceptor is slid along the guide portion and guided.

12. The image forming apparatus according to claim 1, further comprising a fixing unit configured to heat the toner image transferred on the sheet and fix the toner image onto the sheet, wherein the supporting portion is configured to partition a space between the fixing unit and the movement locus by moving from the first position to the second position.

13. The image forming apparatus according to claim 12, further comprising a conveyance path configured to guide the sheet having passed through the fixing unit to the sheet discharge portion, wherein a portion of the conveyance path is comprised of the supporting portion and an opposing guide that opposes to the supporting portion, the supporting portion comprises a first end portion configured to support the first rotary member rotatably, and a second end portion, and the second end portion approaches the opposing guide when the supporting portion moves from the first position to the second position.

14. The image forming apparatus according to claim 1, wherein the cover comprises a supporting section on which the sheet discharged through the sheet discharge portion is supported.

15. An image forming apparatus comprising:

an apparatus body comprising an opening portion;

a cover supported in an openable and closable manner on the apparatus body and configured to cover the opening portion of the apparatus body when in a closed state;

a cartridge configured to be detached from the apparatus body in a detaching direction through the opening portion, the cartridge comprising a developing member configured to develop a toner image on a photoreceptor;

a sheet discharge portion comprising a first rotary member and a second rotary member configured to nip and discharge a sheet on which the toner image has been transferred;

a driving source configured to drive the second rotary member to rotate, the first rotary member being driven to rotate by rotation of the second rotary member; and a supporting portion configured to rotatably support the first rotary member and move, when viewed in an axial direction of the first rotary member, to a first position where the first rotary member overlaps with a movement locus of the cartridge, and to a second position where the first rotary member is positioned upstream of the second rotary member with respect to the detaching direction and where the first rotary member does not overlap with the movement locus, the movement locus being a passage area through which the cartridge passes while being detached from the apparatus body.

16. The image forming apparatus according to claim 15, wherein the supporting portion is positioned at the first position when the cover is in the closed state, and is moved from the first position to the second position when the cover is opened from the closed state.

17. The image forming apparatus according to claim 16, further comprising a connecting portion that connects the cover and the supporting portion, and moves the supporting portion in conjunction with the cover.

18. The image forming apparatus according to claim 15, wherein the supporting portion is supported pivotably with respect to the apparatus body.

19. The image forming apparatus according to claim 15, wherein the supporting portion is supported slidably with respect to the apparatus body.

* * * * *